US009038668B2

(12) United States Patent
Marin et al.

(10) Patent No.: US 9,038,668 B2
(45) Date of Patent: May 26, 2015

(54) ACCUMULATOR ASSEMBLY

(75) Inventors: Carlos E. Marin, Oxford, MI (US); Leonid Basin, Farmington Hills, MI (US)

(73) Assignee: GM Global Technology Operations, LLC, Detroit, MI (US)

( * ) Notice: Subject to any disclaimer, the term of this patent is extended or adjusted under 35 U.S.C. 154(b) by 553 days.

(21) Appl. No.: 13/027,850

(22) Filed: Feb. 15, 2011

(65) Prior Publication Data

US 2011/0226371 A1 Sep. 22, 2011

Related U.S. Application Data

(60) Provisional application No. 61/314,531, filed on Mar. 16, 2010.

(51) Int. Cl.
*F15B 1/24* (2006.01)

(52) U.S. Cl.
CPC ..... *F15B 1/24* (2013.01); *F15B 2201/21* (2013.01); *F15B 2201/31* (2013.01); *F15B 2201/405* (2013.01)

(58) Field of Classification Search
USPC ..... 138/30, 31, 26; 475/129
See application file for complete search history.

(56) References Cited

U.S. PATENT DOCUMENTS 3,669,151 A * 6/1972 Fleming ..... 138/31
3,805,824 A * 4/1974 Robbins, Jr. ..... 137/504
3,893,486 A * 7/1975 Meyers ..... 138/31
4,161,964 A * 7/1979 Greiner et al. ..... 138/26
4,867,294 A * 9/1989 de Tuesta ..... 192/109 F
5,971,027 A * 10/1999 Beachley et al. ..... 138/31
5,996,632 A * 12/1999 Vogel et al. ..... 138/31
6,347,841 B1 * 2/2002 Kim ..... 303/87
6,866,316 B1 * 3/2005 Harder et al. ..... 296/26.09
2007/0007410 A1 * 1/2007 Sirkin ..... 248/262
2007/0241250 A1 * 10/2007 Wong ..... 248/226.11
2009/0095238 A1 * 4/2009 Lak et al. ..... 123/41.49

FOREIGN PATENT DOCUMENTS

DE 2712135 A1 9/1978
DE 10126442 C1 12/2002
DE 10330866 A1 2/2005
DE 10016895 B4 5/2008

* cited by examiner

*Primary Examiner* — Paul R Durand
*Assistant Examiner* — Vishal Pancholi

(57) ABSTRACT

An accumulator assembly is includes a piston located within a pressure canister. The pressure canister has a piston stop therein. The piston stop is located radially outboard of a biasing member or spring located within the pressure canister between the pressure canister and the piston. A support bracket is disposed on an end of the pressure canister in alignment with the spring. The outboard piston stop and the support bracket reduce the stresses due to reaction forces when the accumulator assembly is fully charged. By reducing the stresses due to reaction forces, the accumulator assembly can be made from steel casting or plastic molding without sacrificing the charge capacity of the accumulator assembly.

20 Claims, 3 Drawing Sheets

ACCUMULATOR ASSEMBLY

CROSS-REFERENCE TO RELATED APPLICATIONS

This application claims the benefit of U.S. Provisional Application No. 61/314,531, filed on Mar. 16, 2010. The disclosure of the above application is incorporated herein by reference.

FIELD

The present disclosure relates to an accumulator assembly, and more particularly to a transmission accumulator assembly having structural support and housing features to maximize manufacturing flexibility.

BACKGROUND

The statements in this section merely provide background information related to the present disclosure and may or may not constitute prior art.

A typical automatic transmission includes a hydraulic control system that is used to provide lubrication, cooling, and control to various components of the transmission. A pump circulates the hydraulic fluid under pressure throughout the transmission. The pump is typically driven by the engine of the motor vehicle. During stop and start conditions, it is desirable to turn off the engine in order to maximize fuel efficiency. However, turning off the engine in turn turns off the pump. In order to prime control devices within the transmission, such as clutches and brakes, an accumulator may be employed within the hydraulic control system to provide pressurized hydraulic fluid to the control devices so that the control devices may be engaged quickly without waiting for reengagement of the pump. Current accumulator designs are manufactured from castings of aluminum in order to have sufficient strength. While these accumulator designs are useful for their intended purpose, there is room in the art for an accumulator assembly that provides maximum manufacturing flexibility without reducing the performance characteristics of the accumulator.

SUMMARY

An accumulator assembly is provided. The accumulator assembly includes a piston located within a pressure canister. The pressure canister has a piston stop therein. The piston stop is located radially outboard of a biasing member or spring located within the pressure canister between the pressure canister and the piston. A support bracket is disposed on an end of the pressure canister in alignment with the spring. The outboard piston stop and the support bracket reduce the stresses due to reaction forces when the accumulator assembly is fully charged. By reducing the stresses due to reaction forces, the accumulator assembly can be made from steel casting or plastic molding without sacrificing the charge capacity of the accumulator assembly.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
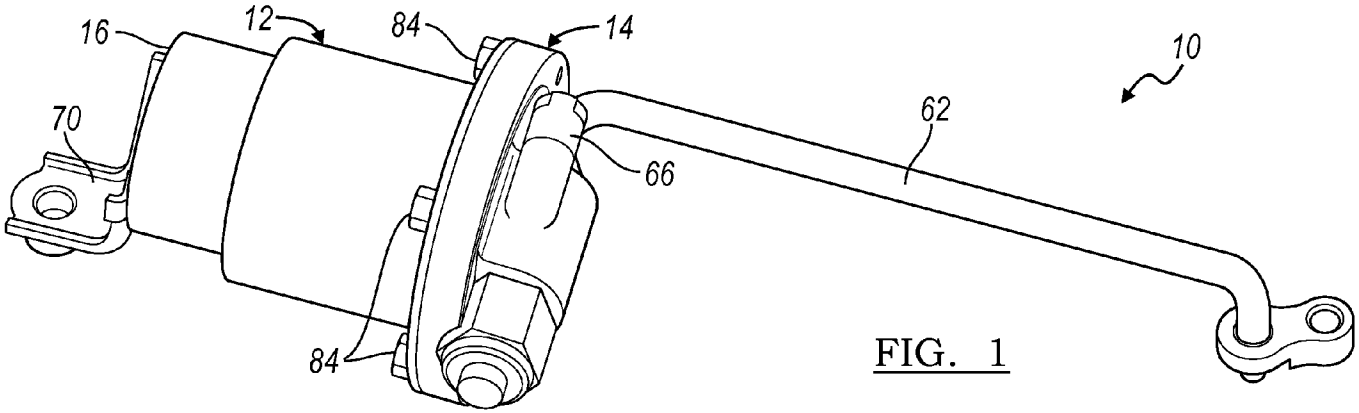
FIG. 1 is a front isometric view of an accumulator assembly according to the principles of the present invention.
Figure 2:
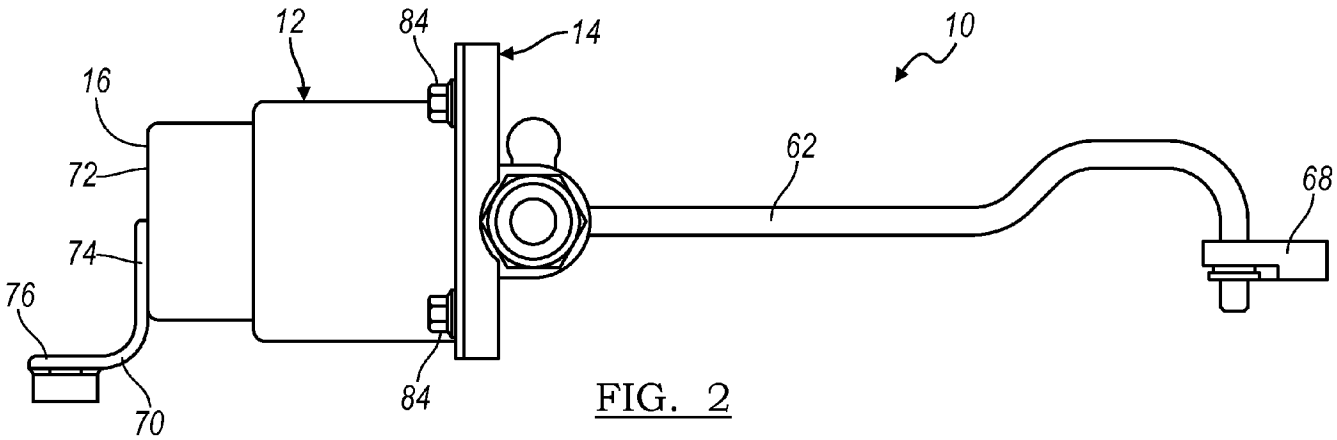
FIG. 2 is a side view of the accumulator assembly according to the principles of the present invention.

The following description is merely exemplary in nature and is not intended to limit the present disclosure, application, or uses.

With combined reference to FIGS. 1-5, an accumulator assembly according to the principles of the present invention is generally indicated by reference number 10. The accumulator 10 is an energy storage device in which a non-compressible hydraulic fluid is held under pressure by an external source. In the example provided, the accumulator 10 is a spring type accumulator that provides a compressive force on the hydraulic fluid within the accumulator 10, as will be described in greater detail below. The accumulator 10 is preferably employed within the hydraulic control system of an automatic transmission (not shown) to enable stop-start operations, however, it should be appreciated that the accumulator 10 may be employed in various other environments, such as fuel injectors, air conditioning systems, etc., without departing from the scope of the present invention.

The accumulator 10 includes a pressure canister 12 and an end cap 14. The pressure canister 12 is generally cylindrical in shape and includes an open end 16 and a closed end 18 opposite the open end 16, best seen in FIG. 5. The open end 18 communicates with a cavity 20 defined by an inner surface 22 of the canister 12. The inner surface 22 has two portions: a first or small portion 24 and a second or large portion 26. The first portion 24 is located proximate the closed end 16 and has a first diameter. The second portion 26 is located between the first portion 24 and the open end 18 and has a second diameter. The second diameter is greater than the first diameter. The interface or junction between the first and second portion 24 and 26 forms a radially extending piston stop 28.

A piston 30 is disposed within the pressure canister 12 and is translatable along an axis "A". The piston 30 includes a disc plate portion 32 and an axially extending rim portion 34. The rim portion 34 extends towards the closed end 16 of the pressure canister 12 and has a distal end surface 36. The piston 30 is slidably disposed within the second portion 26 of the pressure canister 12 and has an outer diameter approximately equal to the second diameter of the second portion 26. The piston 30 is sealed to the inner surface 22 of the pressure canister 30 via a radial seal 38.

A biasing member or spring 40 is disposed within cavity 20 of the pressure canister 12 between the closed end 16 and the piston 30. A first end 42 of the spring 40 contacts the closed end 16 and a second end 44 of the spring 40 contacts an inner surface 46 of the piston disc portion 32 radially inwardly of the rim portion 23. The spring 40 biases the piston 30 towards the open end 18 of the pressure canister 12.

The end cap 14 is connected to the pressure canister 12 and is disposed overtop the open end 18. The end cap 14 includes a radial seal 50 that seals the end cap 14 to the inner surface 22 of the pressure canister 12. The end cap 14 is secured to a radial flange 52 on the pressure canister 14 disposed around the open end 18. In the example provided, the end cap 14 is secured via bolts 5 that extend through the flange 52 and the end cap 14 or via any other type of mechanical fastener. However, where the pressure canister 12 is made from a plastic, the end cap 14 is preferably welded to the flange 52.

Figure 3:
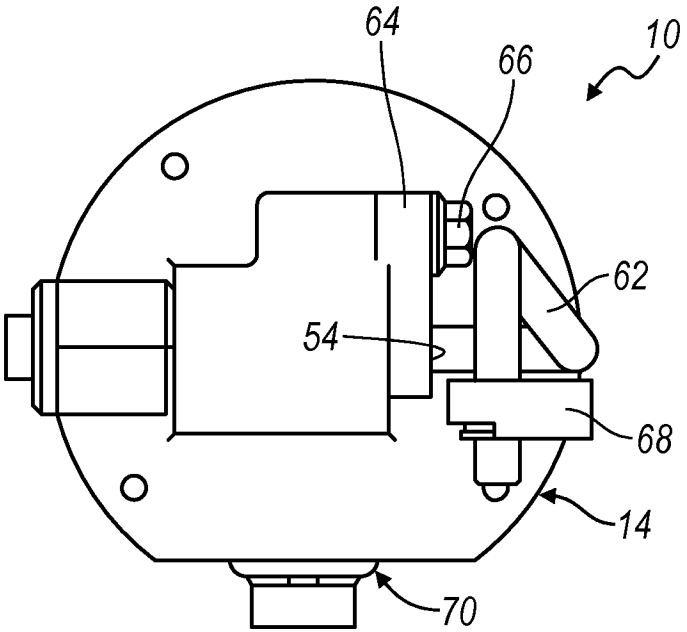
FIG. 3 is a front view of the accumulator assembly according to the principles of the present invention.
Figure 5:
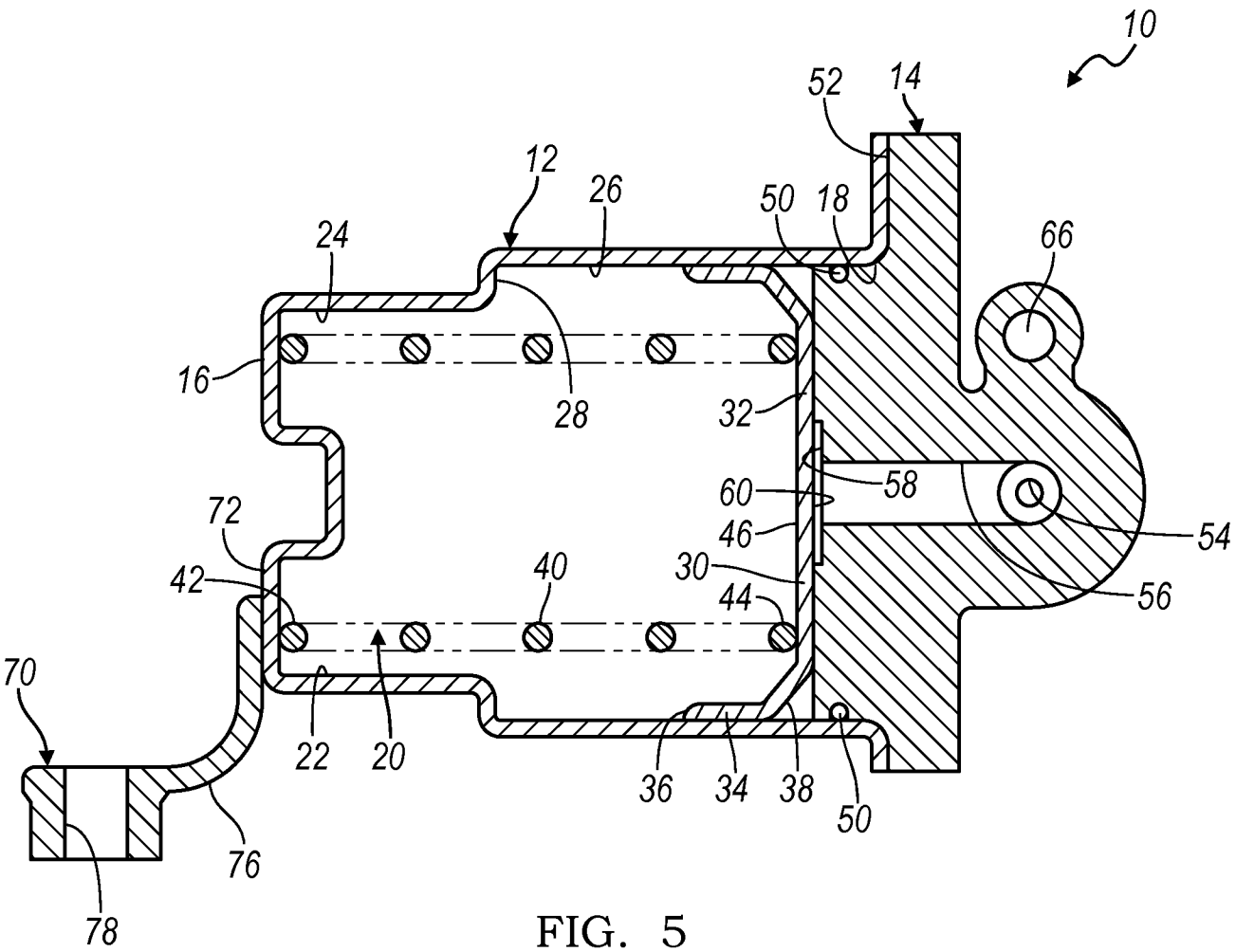
FIG. 5 is a cross-sectional view of the accumulator assembly according to the principles of the present invention.

The end cap 14 has an inlet/outlet port 54 that communicates with a channel 56 formed within the end cap 14. The channel 56 communicates with an opening 58 in the end cap 14. The opening 58 is recessed into the end cap 14 and communicates with an outer surface 60 of the piston 30 within the cavity 20. The inlet/outlet port 54 also communicates with a tube or passageway 62. The pipe 62 is secured to the end cap 14 via a connector ring 64 having an opening for receiving the pipe 62 and an opening for receiving a fastener, such as a bolt 66, to secure the connector ring 64 and therefore the pipe 62 to the end cap 14, as best seen in FIG. 3. A similar connector ring 68 is illustrated at an opposite end of the pipe 62, though the pipe 62 may be connected to the end cap 14 and to any other component in any other way without departing from the scope of the present invention.

Figure 4:
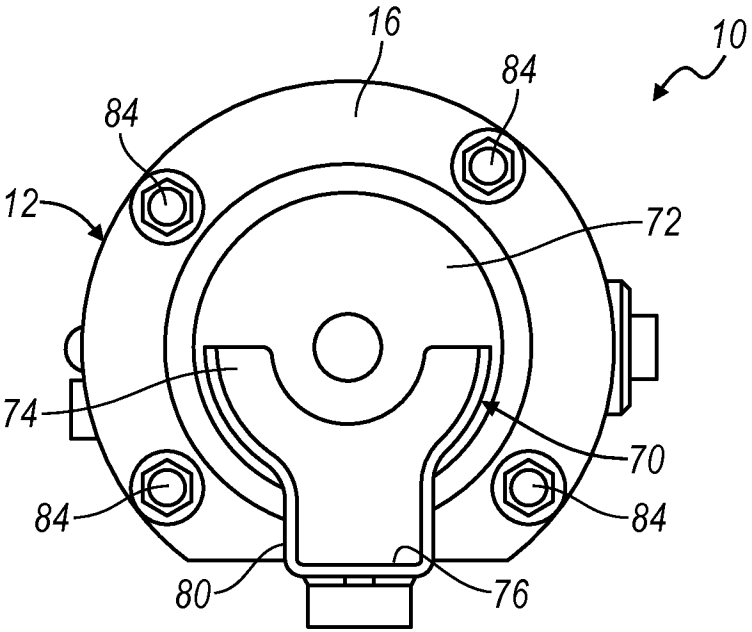
FIG. 4 is an end view of the accumulator assembly according to the principles of the present invention.

The accumulator assembly 10 further includes a support bracket 70 connected to an outer surface 72 of the closed end 16 of the pressurized canister 12, as best seen in FIG. 4. The support bracket 70 includes a first flange portion 74 connected to the outer surface 72. The first flange portion has a semi-circular or circular shape that aligns with the first end 42 of the spring 40 within the pressure canister 12. The support bracket 70 also includes a second flange portion 76 that extends out from the first flange portion 74. The second flange portion 76 is illustrated as being at a right angle to the first flange portion 74, but it should be appreciated that the second flange portion 76 may have other shapes and configurations with respect to the first flange portion 74 without departing from the scope of the present invention. The second flange portion 76 is configured to connect with a fixed component within a transmission, such as the transmission case or housing. In the example provided, the second flange portion 76 includes a bolt hole 78, though it should be appreciated that various other methods of attachment may be employed without departing from the scope of the present invention. The support bracket 70 further includes a support rib 80 along a periphery of the support bracket 70 to add strength to the support bracket 70.

During operation of the accumulator assembly 10, the accumulator assembly 10 is charged when pressurized hydraulic fluid enters the end cap 14 via the pipe 62 and contacts the piston 30. The piston 30 is forced against the biasing force of the spring 40. When the distal ends 36 of the piston 40 contact the stop 28, the piston 40 is in its maximum charged state. Accordingly, the forces acting on the pressure canister 12 are distributed along the stop 28 as well as on the closed end 16 where the spring 40 contacts the closed end. This reaction force is then transferred to the support bracket 70 and in turn to whatever the support bracket 70 is fixed. By distributing the reaction forces of the piston 30 and spring 40 on the pressure canister 12, the stress on the pressure canister 12 is reduced and the pressure canister 12 is able to handle a greater force load. This allows the pressure canister 12 to be manufactured using steel casting or plastic molding without reducing the charge capacity of the accumulator assembly 10. Increased manufacturing flexibility offers cost savings and additionally weight savings which in turn improve the efficiency of the motor vehicle.

The description of the invention is merely exemplary in nature and variations that do not depart from the general essence of the invention are intended to be within the scope of the invention. Such variations are not to be regarded as a departure from the spirit and scope of the invention.

The invention claimed is:

1. An accumulator comprising:

a housing having a closed end and an open end, the housing having an inner surface that defines a first cavity and having a stop located within the first cavity;

a piston disposed within the first cavity, the piston having a non-perforated outer surface, the piston sealed to the inner surface and translatable along an axis;

an end cap separate from the housing and disposed over the open end of the housing, wherein the outer surface of the piston and the end cap define a second cavity, the end cap having an inlet/outlet port in uninterrupted communication with the second cavity for communicating unimpeded a hydraulic fluid in and out of the second cavity;

a biasing member disposed within the housing and located axially between the closed end of the housing and the piston, the biasing member configured to bias the piston towards the open end; and a support member coupled to an outside surface of the closed end of the housing, and wherein the piston stop is located radially outboard of the biasing member.

2. The accumulator of claim 1 wherein a radius of the piston is greater than a radius of the biasing member.

3. The accumulator of claim 1 wherein the stop is formed in the inner surface of the housing and divides the housing into a first portion having a first diameter and a second portion having a second diameter, wherein the first diameter is less than the second diameter, and wherein the piston is disposed within the second portion.

4. The accumulator of claim 3 wherein the piston has a diameter approximately equal to the second diameter of the second portion of the first cavity.

5. The accumulator of claim 1 wherein the housing is made from steel casting or plastic molding.

6. The accumulator of claim 1 wherein the stop is a radially oriented surface portion of the inner surface of the housing.

7. The accumulator of claim 1 wherein the piston includes a disc plate portion that includes the outer surface and an axially extending rim portion, wherein the disc plate portion is oriented perpendicular to the axis and the rim portion extends towards the closed end of the housing.

8. The accumulator of claim 7 wherein the rim portion has a distal end surface configured to contact the stop when the accumulator is fully charged with the hydraulic fluid.

9. The accumulator of claim 1 wherein the support member is at least partially aligned with a portion of the biasing member where the biasing member contacts the inner surface of the closed end of the housing.

10. The accumulator of claim 1 wherein the support member includes a first flange portion connected to the outside surface of the closed end, wherein the first flange portion has a semi-circular or circular shape that aligns with the an end of the biasing member that contacts the inner surface of the first cavity at the closed end, and wherein the support bracket also includes a second flange portion that extends out from the first flange portion, wherein the second flange portion is configured to connect with a fixed component.

11. An accumulator for a hydraulic control system in a transmission of a motor vehicle, the accumulator comprising:

a pressure canister having a closed end and an open end, the pressure canister having an inner surface that defines a first cavity and having a stop located within the first cavity;

a piston disposed within the first cavity, the piston having a non-perforated outer surface, the piston sealed to the inner surface of the pressure canister; and an end cap disposed over the open end of the pressure canister, wherein the outer surface of the piston and the end cap define a second cavity, the end cap having an inlet/outlet port in continuous, uninterrupted communication with the second cavity for communicating unimpeded a transmission oil in and out of the second cavity;

a pipe connected to the inlet/outlet port of the end cap;

a biasing member disposed within the pressure canister and located axially between the closed end of the pressure canister and the piston, the biasing member configured to bias the piston towards the end cap; and a support member coupled to an outside surface of the closed end of the pressure canister, wherein the piston is translatable along an axis between a charged position where the piston contacts the stop and a discharged position where the piston at least partially contacts the end cap, wherein the piston stop is located radially outboard of the biasing member, and wherein the piston exerts a force at the stop of the pressure canister thereby limiting the force exerted by the compression of the biasing member on the closed end of the pressure canister when the piston is in the charged position.

12. The accumulator of claim 11 wherein a radius of the piston is greater than a radius of the biasing member.

13. The accumulator of claim 1 wherein the stop is formed in the inner surface of the pressure canister and divides the pressure canister into a first portion having a first diameter and a second portion having a second diameter, wherein the first diameter is less than the second diameter, and wherein the piston is disposed within the second portion.

14. The accumulator of claim 13 wherein the piston has a diameter approximately equal to the second diameter of the second portion of the cavity.

15. The accumulator of claim 11 wherein the pressure canister is made from steel casting or plastic molding and has sufficient charge capacity to charge the hydraulic control system of the motor vehicle to enable stop/start operations.

16. The accumulator of claim 11 wherein the stop is a radially oriented surface portion of the inner surface of the pressure canister.

17. The accumulator of claim 11 wherein the piston includes a disc plate portion that includes the non-perforated outer surface and an axially extending rim portion, wherein the disc plate portion is oriented perpendicular to the axis and the rim portion extends towards the closed end of the pressure canister.

18. The accumulator of claim 17 wherein the rim portion has a distal end surface configured to contact the stop when the accumulator is fully charged with the transmission oil.

19. The accumulator of claim 11 wherein the support member is at least partially aligned with a portion of the biasing member where the biasing member contacts the inner surface of the closed end of the pressure canister.

20. The accumulator of claim 11 wherein the support member includes a first flange portion connected to the outside surface of the closed end, wherein the first flange portion has a semi-circular or circular shape that aligns with the an end of the biasing member that contacts the inner surface of the first cavity at the closed end, and wherein the support member also includes a second flange portion that extends out from the first flange portion, wherein the second flange portion is configured to connect with a fixed component.

* * * * *